United States Patent [19]

Mallek et al.

[11] 4,156,393

[45] May 29, 1979

[54] INCINERATOR

[75] Inventors: Heinz Mallek, Linnich-Tetz; Dieter Kuhnert, Sinsheim; Friedrich Scholz, Muhlacker, all of Fed. Rep. of Germany

[73] Assignee: Kraftanlagen Aktiengesellschaft, Heidelberg, Fed. Rep. of Germany

[21] Appl. No.: 816,887

[22] Filed: Jul. 18, 1977

[30] Foreign Application Priority Data

Jul. 23, 1976 [DE] Fed. Rep. of Germany ..... 2633128

[51] Int. Cl.[2] ..... F23G 5/00; F23L 17/00

[52] U.S. Cl. ..... 110/208; 110/210; 110/214; 110/300

[58] Field of Search ..... 110/208, 209, 210, 214, 110/237, 248, 267, 300, 249, 259, 168, 169

[56] References Cited

U.S. PATENT DOCUMENTS

| | | | |
|---|---|---|---|
| 739,491 | 9/1903 | Grey | 110/300 |
| 1,178,273 | 4/1916 | Simmons | 110/300 |
| 1,213,708 | 1/1917 | Sykes | 110/168 |
| 2,145,261 | 1/1939 | Hiler | 110/259 |
| 2,653,213 | 9/1953 | Comstock | 110/259 |
| 3,485,190 | 12/1969 | Pelletier | 110/210 |
| 3,670,667 | 6/1972 | Faurholdt | 110/214 |
| 4,048,927 | 9/1977 | Mallek et al. | 110/208 |
| 4,063,521 | 12/1977 | Pech | 110/208 |

*Primary Examiner*—Henry C. Yuen

*Attorney, Agent, or Firm*—Flynn & Frishauf

[57] ABSTRACT

Sluice gate members mounted for swinging movement about a shaft offset from the center of a furnace and arranged to be moved both gradually and discontinuously are interposed between an upper pyrolysis and precombustion chamber and a lower afterburning chamber. The movement of these sluice gate members causes particles of the fire bed supported on them to drop down into the afterburning chamber, largely in the form of embers, at about the same rate as additional waste material is added to the fire bed, so as to maintain a fire bed of approximately constant size. The sluice gate members are hollow and secondary air is blown into them near the shafts on which they are mounted and flows out through holes on their bottom surfaces and in their facing tip edges and then proceeds downward to contribute to the afterburning process.

8 Claims, 5 Drawing Figures

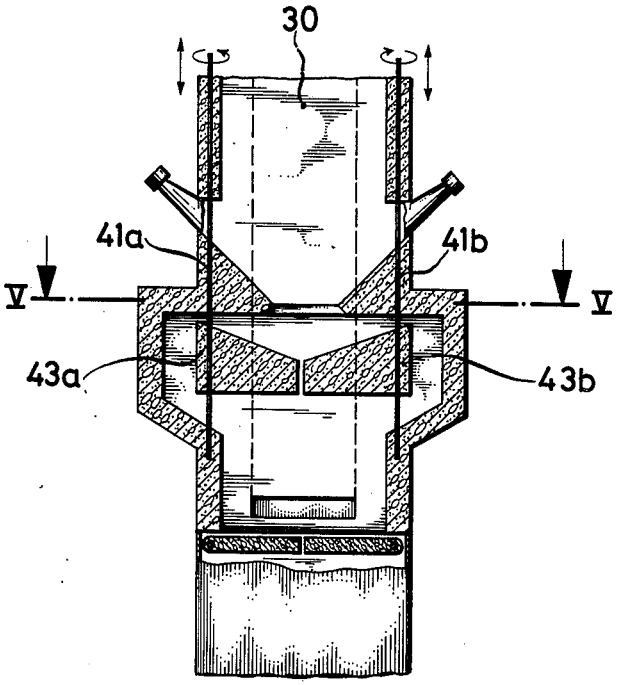
FIG. 4
FIG. 5
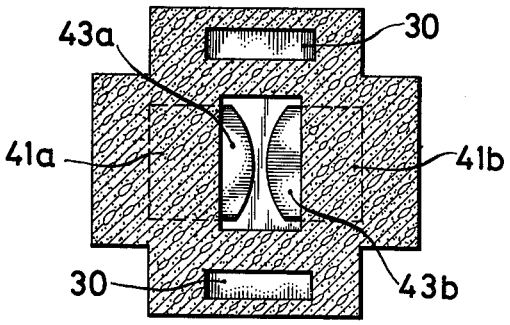

INCINERATOR

The invention relates to an installation for the combustion of solid waste which may also—if required—be used for solid waste with liquid mixed in. The furnace is subdivided into two vertically arranged sections, an pyrolysis and precombustion chamber and an afterburning chamber.

Another installation is already known for the combustion of waste in which the vertically arranged successively used components of the combustion chamber, main chamber and afterburning chamber, are separated by a grate. The main combustion chamber does not lead directly into the afterburning chamber, but into a tube of heatproof material which is provided within the afterburning chamber; thus, gases and combustion residues from the main combustion chamber behind (above) the grate are led into the afterburning chamber downwards in the direction of the flaps of a lockable opening in the bottom. The residues are deposited on these flaps and the gases are guided upwards into the annular space around the tube and led off via openings arranged in the walls of the afterburning chamber. The grate, which subdivides the installation, as shown in German published patent application No. (OS) 24 44 125, consists of at least two parts each pivoted on a horizontal shaft.

The installation just described was designed for the treatment of radioactive waste and sought to obtain, at the outlet of the afterburning chamber, flue-gases and combustion residues that are almost free of combustible constituents, by means of a simple and compact construction easy and safe for operation and maintenance. By moving the grate, combustion residues were designed to be sifted out, while unburned constituents of small dimensions that also fall through the central section, could be burnt out on the bottom flaps of the afterburning chamber by contact with the hot, oxygen-containing gases U.S. Pat. No. 4,048,927.

The above-described installation makes it possible to burn almost completely the most diversified waste materials with intermittent feed. Installations which are provided with a grate between the main combustion and afterburning chamber give the advantage of independence from the size of the pieces; on the other hand, grates tend to become clogged and ineffective, giving rise to cooling problems.

In contrast to the above, it is an object of the present invention to burn unsorted waste material of most diversified types and size distribution with effective external control of the flow of waste material and gases through the installation in a manner suitable to the combustion properties of the particular furnace contents, so as to form and maintain a fire bed in the initial combustion chamber and to sift the bed particles so that only particles of small size, which are formed in accordance with the combustion properties in various zones of the initial combustion chamber, will be delivered to the lower afterburning chamber, while at the same time a sufficient proportion of the heat of the fire bed is supplied for an upper drying process and for intermediate level degasifying and lower level gasifying processes.

SUMMARY OF THE INVENTION

Briefly, a sluice gate for supporting an fire bed, as well as material to be pyrolyzed above the fire bed, is provided between a pyrolysis and precombustion chamber and the afterburning chamber, the sluice gate consisting of at least one horizontally pivoted sluice gate member having an unbroken top surface and defining at its free end a gap the size of which may be varied by causing the sluice gate member to pivot about its horizontal axis. The sluice gate member or members are controllable to vary the gap area continuously or discontinuously by an external handle or a drive. Preferably, there is a pair of sluice gate members pivoted on parallel axes defining a controllable gap between their free ends. Preferably, also, the sluice gate members are hollow and are used to feed secondary air for the afterburning chamber through holes or slits in their undersides and ends.

The rotary or swinging sluice gate members provide for formation of a fire bed above them in the initial combustion chamber and for maintaining a constant heat bed volume which will provide heat storage. The heat storage stabilizes the heat flows, which are variable with time and different in location, striking a balance between the endothermic drying, degassing (pyrolysis) and gasifying processes and the exothermic partial combustion process within the pyrolysis and precombustion chamber. The great surface and the high temperatures of the fire bed cause a complete separation to an unexpected degree of the products resulting from the individual processes. During all processes, a reduction in volume is produced. By the motion of the sluice gates, the course of combustion is controlled from the outside so that only after its particle size has been considerably reduced does material get through the controlled passage from the fire bed into the afterburning chamber.

Sluice gates can be of pivoted roller type, round or oval in vertical cross-section, or pivoted or swiveling platelike elements of rectangular or tapered section or they may be alternately tapering conical elements. For the horizontal swivel axis case, platelike sluice gate members hinged on such axes, which are moved between a horizontal position and a lower oblique position, are of advantage. The hinge axis of such sluice gate members preferably runs along the edge of a projecting internal chamber structure outside the main flow of the gases. A platelike rotary element, which has a round or oval form from top view, can also be supported on a vertical shaft or axis and in inclined position against the horizontal and can be rotated and/or moved by a drive. These also can be provided with air distribution channels with outlets on the side turned away from the fire bed.

With platelike elements, a debris cone of ash and unburned constituents forms even when they move, an effect that has proved to be an efficient protection against the high furnace-heat capacity in this zone. The fire bed constituents which are reduced to the dimensions of the cross-sectional areas of passage between the operating range of the sluice gates are passed over to the afterburning chamber and gather as glowing ashes on the flaps of the controllable bottom closure. The yet unburned ash constituents and the pyrolytic gases of the pyrolysis and precombustion chamber are completely burnt up in the afterburning chamber by the secondary air supplied through the sluice gate members.

The invention is further explained by way of illustrative example with reference to the annexed drawing, in which:

FIG. 1 diagrammatically represents a vertical section of a furnace installation according to the invention;

FIG. 4 is a diagrammatic vertical section of still another form of furnace according to the invention; and FIG. 5 is a horizontal section of the furnace of FIG. 4 along the line V—V of FIG. 4.

Figure 1:
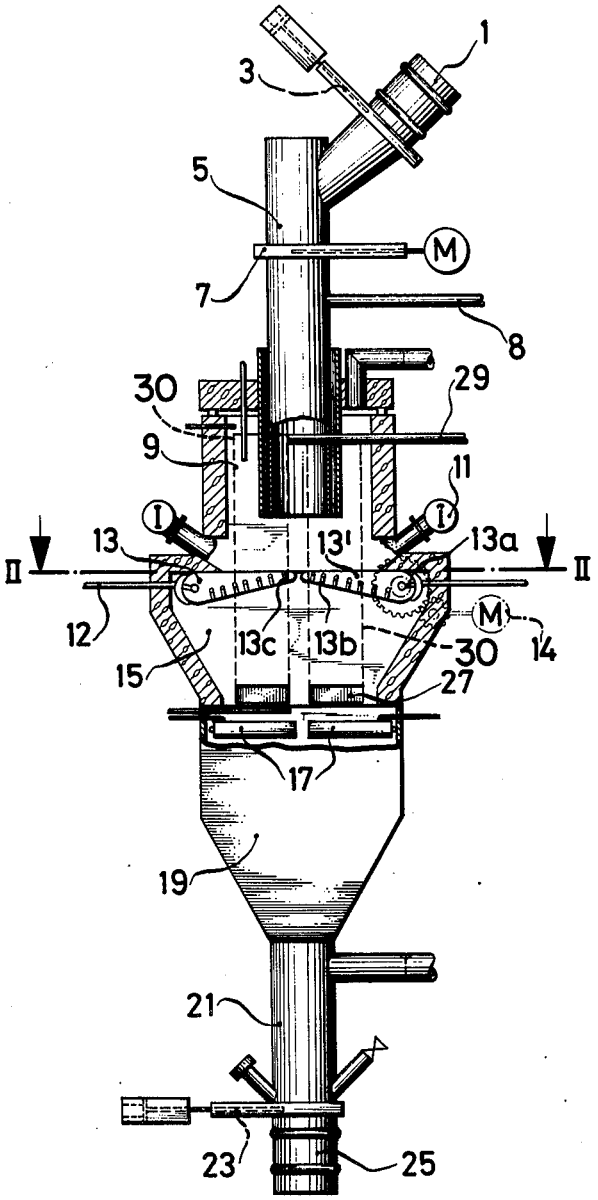

As shown in FIG. 1, the material to be incinerated is brought in a barrel 1 that is emptied through the sluice or gate 3 into the charging hopper 5, where it rests on the horizontal gate valve 7 until the latter slides open. Then the material falls down into the pyrolysis and precombustion chamber 9. Burners 11 are provided for starting up operations. Initial combustion of the waste material can usually be produced without admixing additional fuel after ignition by admitting a controlled quantity of primary combustion air by the pipe 8 and between baffle plates, not shown in the drawing, which lead downwards and as a group extend to the neighborhood of the sluce gate members 13,13'.

During the drying, degassing and gasifying (pyrolysis) processes, the fire bed and the waste are moved and stirred up by both discontinuous and continuous swinging of the platelike sluice gate members 13,13' between the horizontal upper position shown in the figure and an oblique position below the plane of their parallel pivot axes. Due to this motion, the free passage cross-sectional area between initial combustion chamber 9 into the afterburning chamber 15 varies. The motion is produced by drive means 14, which may be a motor drive, hand crank, hand wheel, or the like, with or without a built-in programmed motion cycle. The motion of the two members 13 and 13' is coupled by gears or links not visible in the view given in FIG. 1. The frequency and amplitude of swing of the sluice gate members 13,13' is such as to provide a balance between the rate of admission of material into the initial combustion chamber and the downward discharge embers, in order to keep constant the volume of the fire bed. For example, for a charging rate of 80 Kg./hr- of hospital waste with an average calorific value of 3000 Kcal/kg, a swing of 15° at a frequency of 0.005 Hz has been found suitable.

The movable sluice gate members, which are designed as hollow pendulum-type flaps, are each provided with inlet openings **13*a* near the pivot axis and with outlet openings on the underside 13*b* and in the tip edge 13*c*. Air for final combustion is admitted from the line 12 into the inlets 13*a*** of the sluice gates.

The afterburning chamber 15, which is disposed below the movable sluice gates 13,13', has two ash discharging flaps 17 at the bottom of the chambers on which fire-bed droppings are gathered as glowing ash.

Another chamber 19 is provided below the ash discharge flaps 17 for cooling off the ash. The cooled ash is led down to an ash barrel 25 through the direct path provided by an ash outlet hopper and pipe 21 and its discharge gate 23 fitted at its bottom end.

The furnace flue-gases of the afterburning chamber 15 escape through openings 27 located above the ash discharge flaps 17; then they are led in an upward direction and strike the walls of the afterburning chamber, and subsequently those of the pyrolysis and precombustion chamber, from the outside. The flue-gases are led through filters (which are not shown in the figure) on the surfaces of which ash particles are separated. The gases are drawn out of the furnace installation by the suction line 29 through the flues 30 more clearly shown in FIG. 2. The contribution of heat by the furnace flue-gases through the walls of the initial combustion chamber is of great importance for maintaining the combustion process within the fire bed and assuring sufficient heat supply during the drying, degassing and gasifying processes within the pyrolysis and precombustion chamber. The residue is obtained as disinfected ash and free of combustible constituents, regardless of the nature of the original material, whether general rubbish, hospital waste or carcasses.

Figure 2:
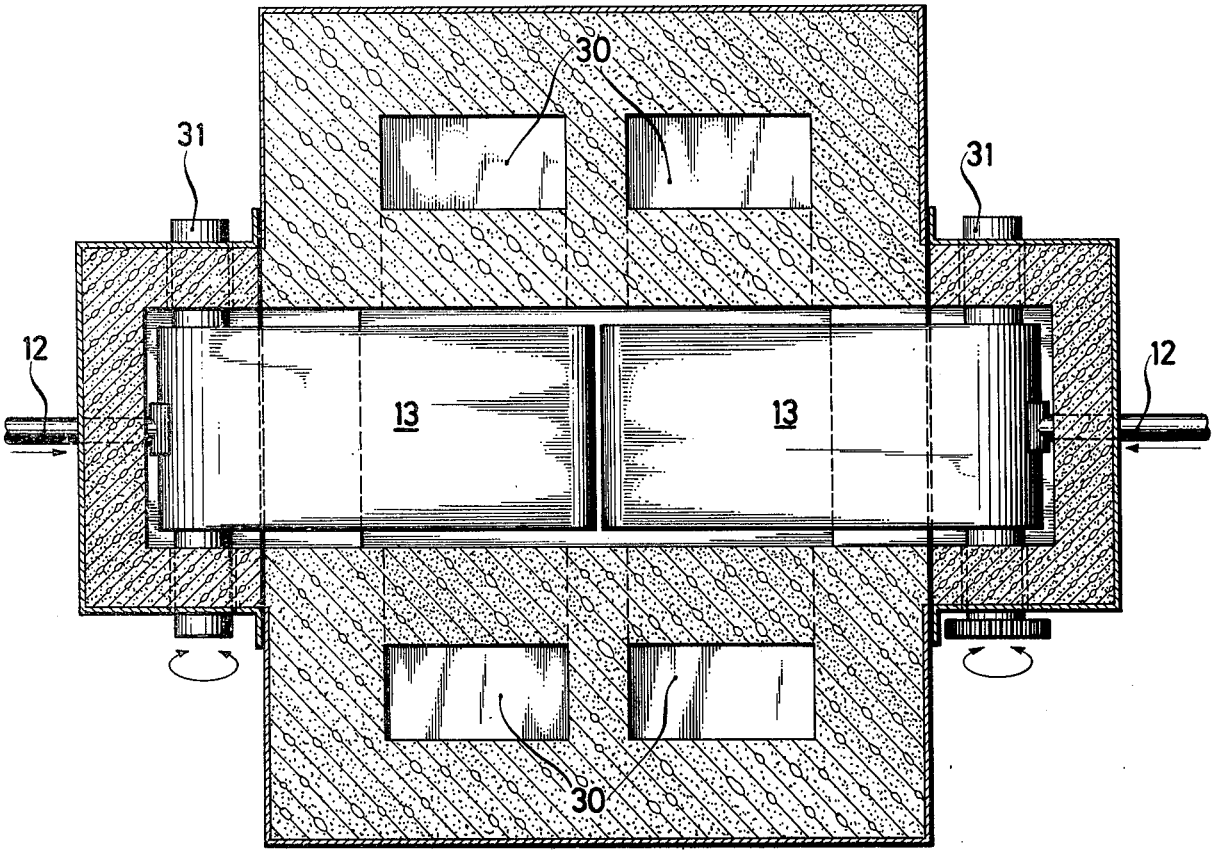
FIG. 2 is a diagrammatic section of another form of furnace according to the invention.
Figure 3:
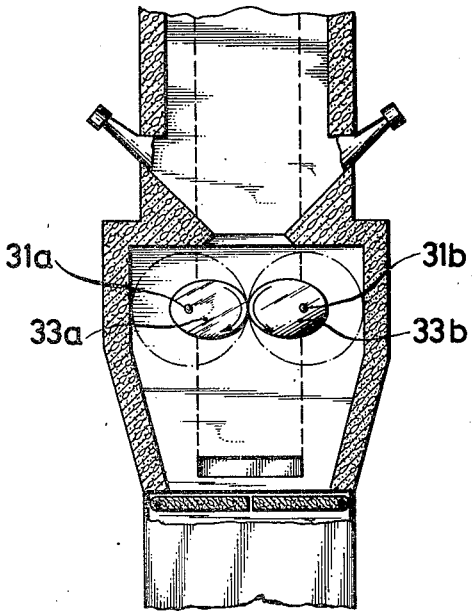
FIG. 3 is a diagrammatic section of another form of furnace according to the invention.

FIG. 2 shows a cross-section of the apparatus illustrated in FIG. 1, along the line II—II together with a top view of the sluice elements 13. The representation furthermore shows a section through the flue gas channels 30 arranged in the walls of the pyrolysis and precombustion chamber and the afterburning chamber. The waste gases flow through openings 27 into the flue gas channels 30 and are thence drawn by suction through the duct 29 shown in FIG. 1. The section of the installation in the region of the sluice elements is shown in FIG. 3. The roller-like sluice elements 33 lie opposite each other, are rotatably mounted on horizontal shafts 31 and have an oval cross-section. One of the possible modes of movement of these sluice elements consists in that their rotation operates in opposed directions, i.e. the left sluice element **33*a* is rotated clockwise and the right sluice element 33*b* counter-clockwise on the respective shafts 31*a* and 31*b*** discontinuously or continuously. By this rotation, passage cross-sections of different sizes are cleared between the sluice elements for the pyrolysis residues of the upper chamber. In their passing the plane of the sluice elements, a kind of kneading effect is at the same time exerted on the solid pyrolysis residues, by which the pyrolysis residues are reduced to an intended particle size. The drive of the sluice elements can be performed manually or provided by a motor.

A further modification of the form of the shape of the sluice elements is shown in FIGS. 4 and 5. Sluice elements **43*a* and 43*b* are supported on shafts or axles 41** set vertically within the upper chamber walls and thus outwardly beyond the ember bed of the sluice elements. The size of the sluice elements facing the pyrolysis and precombustion chamber are plane and slope down towards the middle of the initial combustion chamber.

FIG. 5 shows a cross-section of the installation shown in FIG. 4, along the line C–D. From this illustration, it can be recognized that the sluice elements **43*a* and 43*b*** are rounded off on their sides that face each other, so that a simultaneous oscillating movement of the sluice elements is possible. A drive for the sluice elements that is not shown thus produces a reshuffling of the ember bed and at the same time, the pyrolysis residues are sluiced out of the initial combustion chamber as soon as they have been reduced below a certain particle size.

We claim:

1. A furnace for the combustion of waste material that is at least partly solid, said furnace comprising, in combination:

an afterburning chamber;

a pyrolysis and precombustion chamber located above said afterburning chamber and having its bottom formed of at least one sluice gate member movable in a swinging or rotary motion about a shaft or axis in such a way as to open or restrict a passageway through which particles of a fire bed above said sluice gate member or members may fall into said afterburning chamber, means external to the furnace for producing gradual angular movement of each said sluice gate member about an axis and also intermittent angular movement of each said sluice gate member about said axis, and passages (30) for the combustion product gases issuing from said afterburning chamber disposed around the outside of said pyrolysis and precombustion chamber (9) for heating the latter and promoting pyrolysis therein.

2. A furnace as defined in claim 1, in which each said movable sluice gate member is of round or oval vertical cross-section and is mounted for rotation on a horizontal shaft.

3. A furnace as defined in claim 1, in which each sluice gate member is of platelike form and of rectangular or tapered cross-section and arranged to be moved in an oscillatory movement about said axis.

4. A furnace as defined in claim 3, in which there are two sluice gate members, each of which is mounted so as to pivot on a horizontal axis offset from the vertical central axis of the furnace, and in which said means for producing movement of said member or members are means for moving each member between a position in which the upper surface thereof is horizontal and said passageway is most restricted and a position in which said surface is located obliquely below the horizontal and said passageway is most open.

5. A furnace as defined in claim 4, in which each said sluice gate member is pivoted on a horizontal hinge axis substantially at the edge of a structure attached to at least one wall of said furnace projecting inward from said wall, but not projecting into the portion of said furnace in which the main flow of gases in said furnace takes place.

6. A furnace as defined in claim 3, in which each said platelike sluice gate member has a shape as projected on a horizontal plane that is round or oval and is supported with its upper surface oblique to the horizontal by a vertically running shaft in such a manner that said upper surface dips generally downward from its attachment to said shaft, and in which said means for producing movement of said members is a drive for rotating said member and/or moving it up and down in a vertical direction.

7. A furnace as defined in claim 3, in which each said sluice element is provided with gas inlet openings near said shaft or axis about which said member is movable and also is provided with gas outlet openings on its underside for leading secondary air to the transition zone in said furnace below said pyrolysis and precombustion chamber and above said afterburning chamber.

8. A furnace as defined in claim 7, in which each said sluice gate member is provided with gas outlet openings in its edge portion farthest removed from said axis or shaft about which said member is movable.

* * * * *